US005911573A

United States Patent [19]

Tsai

[11] Patent Number: 5,911,573

[45] Date of Patent: Jun. 15, 1999

[54] GAS LIGHTER WITH A CIGAR CUTTER

[76] Inventor: Chin-Lin Tsai, 3F, No. 94, Sec. 3, Chung Hsin Road, San Chung City, Taipei Hsien, Taiwan

[21] Appl. No.: 08/984,524

[22] Filed: Dec. 3, 1997

[51] Int. Cl.[6] ..... F23Q 2/34

[52] U.S. Cl. ..... 431/253; 131/243; 131/248; 131/249

[58] Field of Search ..... 431/253; 131/243, 131/248, 249

*Primary Examiner*—Ira S. Lazarus
*Assistant Examiner*—Donna Mann
*Attorney, Agent, or Firm*—Bacon & Thomas, PLLC

[57] ABSTRACT

A gas lighter which includes a gas lighter unit controlled by a press button switch to produce a flame at a flame nozzle thereof for burning, a sliding track at one side of the gas lighter unit, a slide box mounted in the sliding track and moved in and out of a bottom side of the gas lighter unit, a slide moved in and out of the slide box and holding a cutter blade for cutting a head of a cigar being inserted into a blade hole on the slide box, and a sliding switch adapted to lock the slide box and the slide when the slide box and the slide are received inside the gas lighter unit.

10 Claims, 4 Drawing Sheets

GAS LIGHTER WITH A CIGAR CUTTER

BACKGROUND OF THE INVENTION

The present invention relates to gas lighters, and more particularly to such a gas lighter which is equipped with a cigar cutter.

Dried tobacco leaves may be treated in various ways and used for smoking. When to smoke a cigar, the closed head must opened. It is inconvenient to open the head of a cigar with the hands or the teeth. A cigar smoker may use a cigar cutter to cut the head of the cigar before smoking, and then use a gas lighter to burn the cut head of the cigar. Therefore, a cigar smoker may have to carry with one self a cigar cutter and a gas lighter for ready use.

SUMMARY OF THE INVENTION

The present invention has been accomplished under the circumstances in view. According to one aspect of the present invention, the gas lighter which a gas lighter unit adapted for producing a flame for burning, and a cigar cutter together coupled to the gas lighter unit and adapted for cutting the head of a cigar. According to another aspect of the present invention, the cigar cutter comprises a slide box moved in and out of the housing of the gas lighter unit, a slide moved in and out of the slide box and holding a cutter blade for cutting the head of a cigar being inserted into a blade hole on the slide box, and lock means adapted to lock the slide box and the slide in the housing of the gas lighter unit.

BRIEF DESCRIPTION OF THE DRAWINGS

In order that the present invention may more readily be understood the following description is given, merely by way of example with reference to the accompanying drawings, in which.

DETAILED DESCRIPTION OF THE PREFERRED EMBODIMENT

Figure 1:
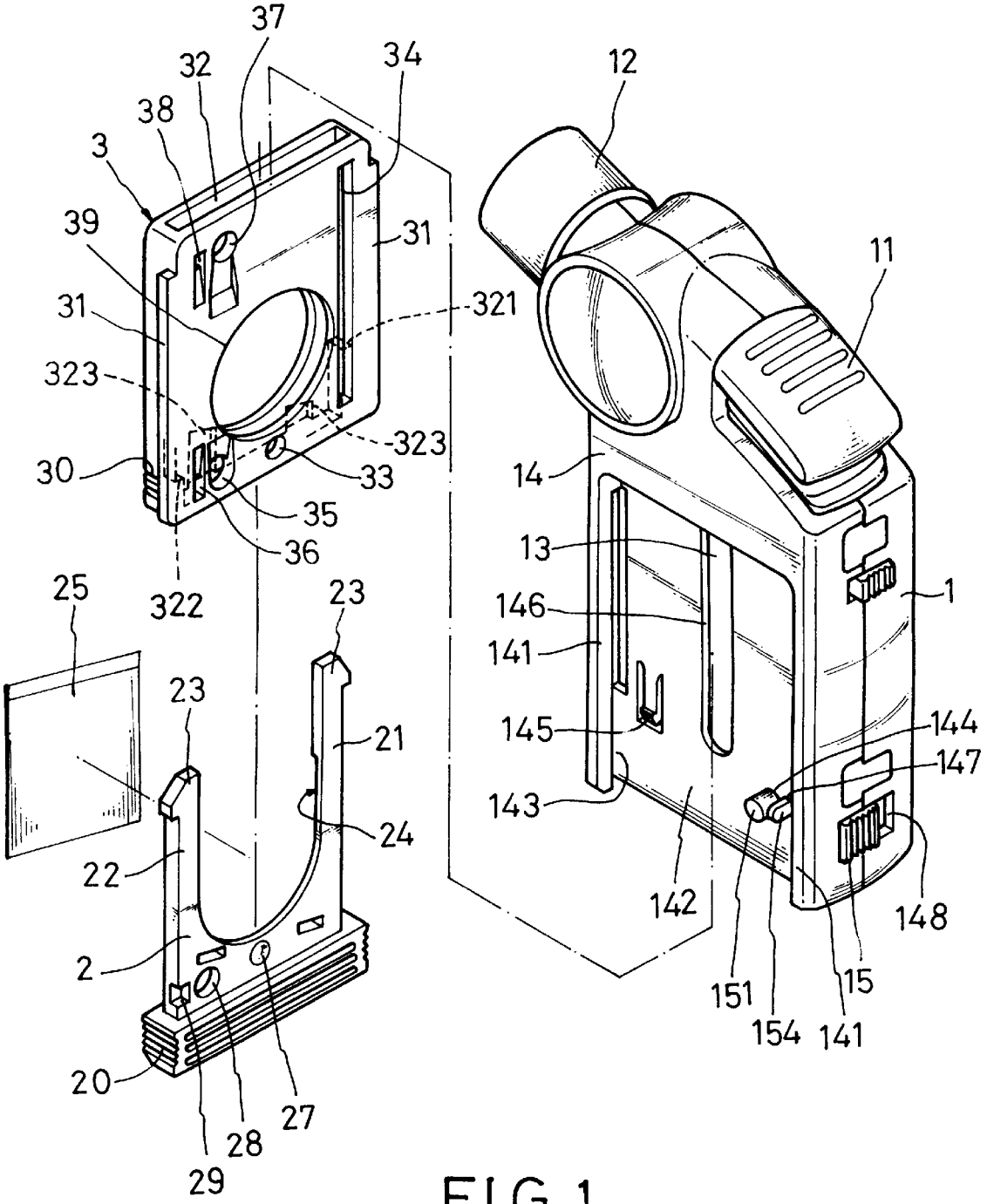
FIG. 1 is an exploded view of a gas lighter with a cigar cutter according to the present invention.
Figure 2:
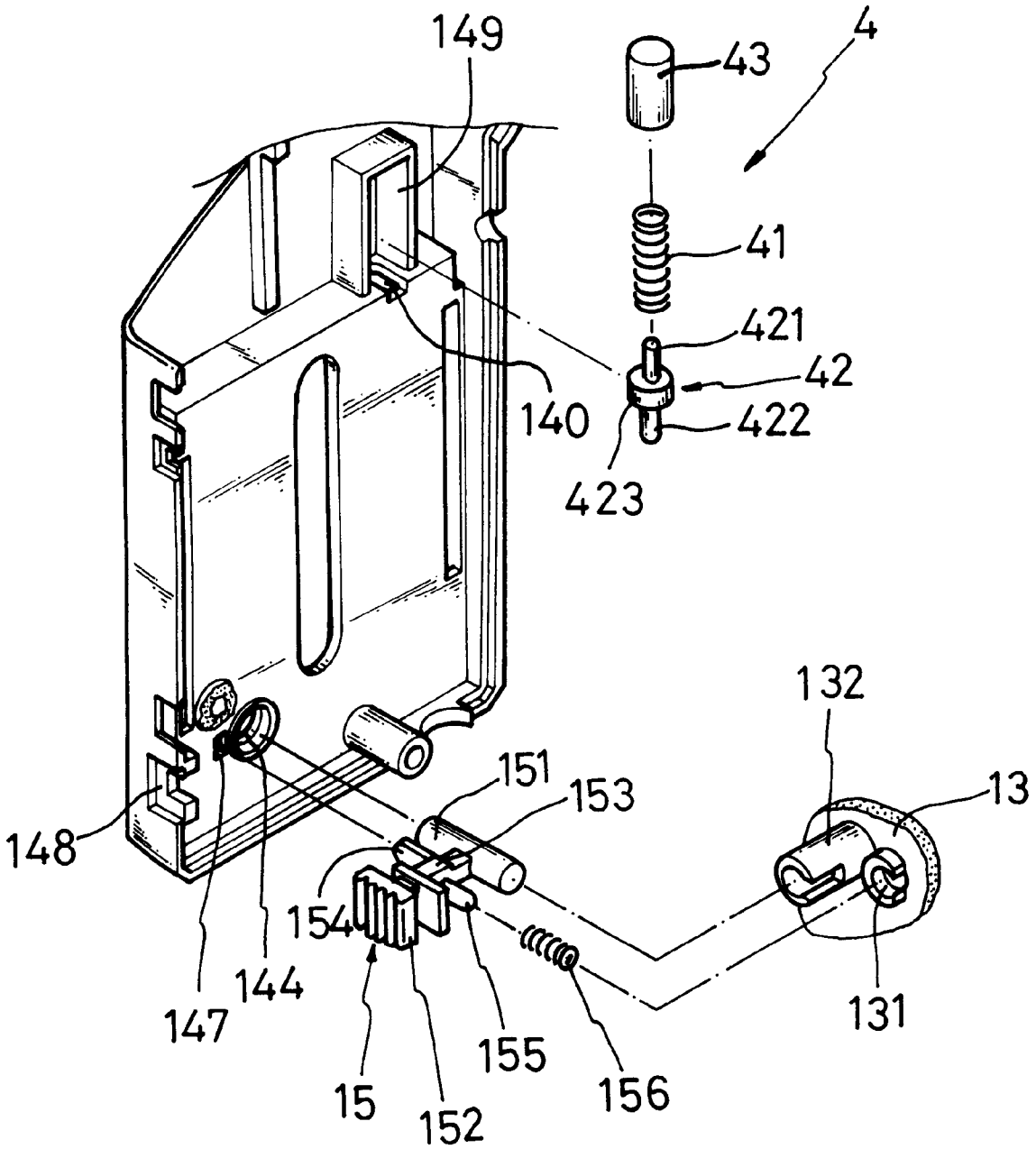
FIG. 2 is an exploded view of a part of the present invention, showing the structure of the sliding switch and the ejector.

Referring to FIGS. 1 and 2, a gas lighter with a cigar cutter in accordance with the present invention is generally comprised of a gas lighter unit 1, a slide box 3, a slide 2, and an ejector 4.

The gas lighter unit 1 comprises a flame nozzle 12 at which discharged fuel gas is burned, a butane well 13 which holds a liquefied fuel gas, a press button switch 11 which controls the gas output port of the butane well 13 and the operation of an igniter (not shown), and a gas filling valve means (not shown) at the bottom side through which fuel gas is filled into the butane well 13. The housing 14 of the gas lighter unit 1 comprises two longitudinal side rails 141 bilaterally raised from one side wall 142 thereof, two longitudinal sliding grooves 143 defined between the side wall 142 and the side rails 141 for the mounting of the slide box 3, a sliding switch 15 moved in a transverse sliding slot 148 at its back side, the sliding switch 15 adapted to lock the slide 2 and the slide box 3, a springy hook 145 integral with the side wall 142 for stopping the slide box 3 from escaping out of the gas lighter unit 1, and a longitudinal peephole 146 through which the quantity of liquefied fuel gas in the butane well 13 is viewed.

Referring to FIGS. 1 and 2 again, the sliding switch 15 comprises a flat knob 152 disposed outside the sliding slot 148 on the housing 14, a first locking rod 151 disposed in parallel to the flat knob 152 and moved with the sliding switch 15 in and out of a through hole 144 on the side wall 142 of the housing 14 for locking/unlocking the slide box 3, a transverse rod 153 inserted through the sliding slot 148 and fixedly connected between the flat knob 152 and the first locking rod 151, a second locking rod 154 perpendicularly raised from the transverse rod 153 at one side and moved with the sliding switch 15 in and out of a through hole 147 on the side wall 142 of the housing 14 for locking/unlocking the slide 2, a locating rod 155 perpendicularly raised from the transverse rod 153 at one side opposite to the second locating rod 154, and a compression spring 156 mounted around the locating rod 155 and received in a spring holder 131 on the outside wall of the butane well 13. The compression spring 156 imparts an outward pressure to the transverse rod 153, causing the first locking rod 151 and second locking rod 154 to be respectively moved out of the respective through holes 144;147. Further, there is provided a guide tube 132 raised from the outside wall of the butane well 13, and adapted to guide the movement of the first locking rod 151.

The ejector 4 is mounted in a trough 149 on the side wall 142 at the top within the housing 14, and adapted to push the slide box 3 outwards along the sliding grooves 143. The ejector 4 comprises a cylindrical block 43 mounted in the trough 149 at the top side, a push member 42 mounted in the trough 149 at the bottom side, and a spring 41 connected between the cylindrical block 43 and the push member 42. The push member 42 comprises a cylindrical base 423 mounted in the trough 149 above a hole 140 at the bottom side of the trough 149, a locating rod 421 perpendicularly raised from the cylindrical base 423 at the top and adapted to hold the spring 41, and a push rod 422 perpendicularly raised from the cylindrical base 423 at the bottom and inserted through the hole 140 at the bottom side of the trough 149. After the slide box 3 has been released from the locking rod 151, the push member 42 is forced downward by the spring 41, thereby causing the push rod 422 to push the slide box 3 downwards along the sliding grooves 143.

Figure 3:
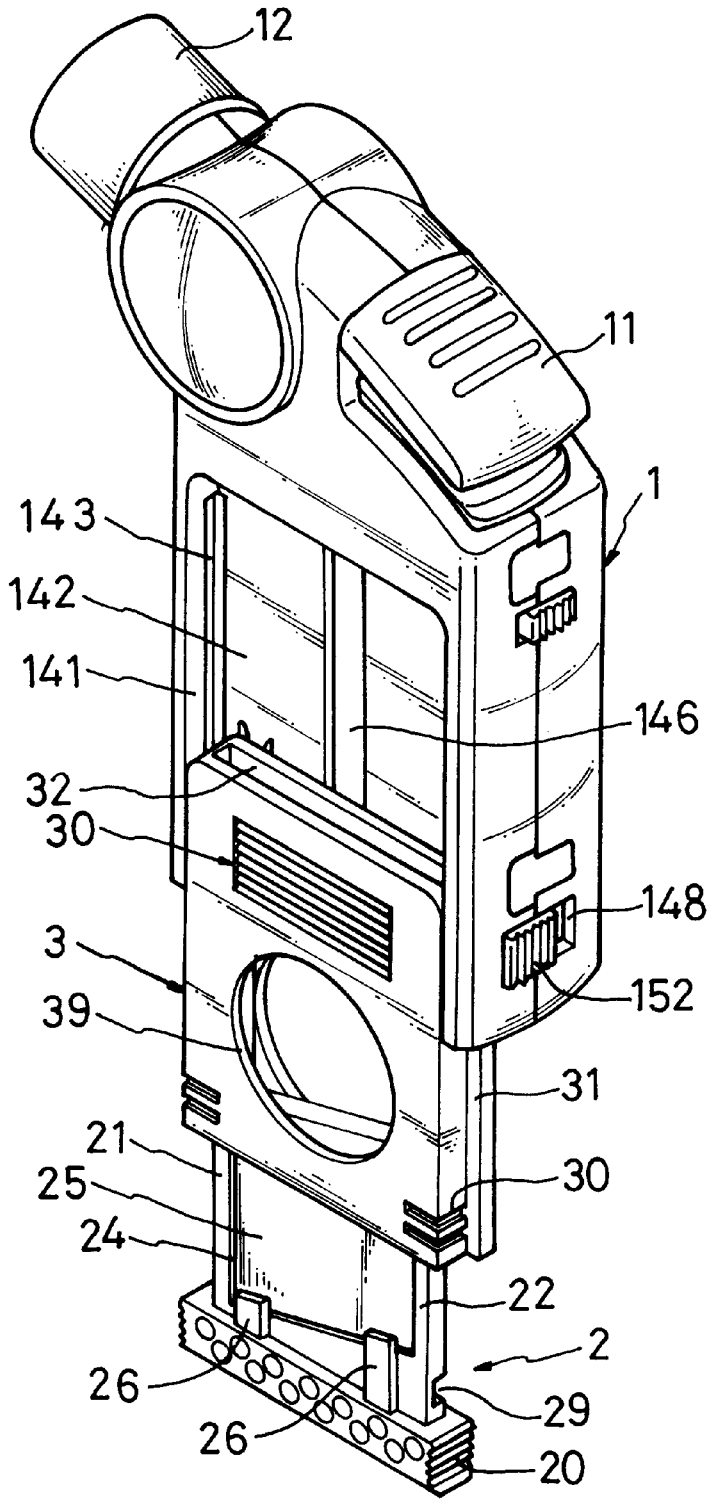
FIG. 3 is a perspective view of the present invention, showing the slide extended out of the slide box, the slide box extended out of the housing of the gas lighter unit.
Figure 4:
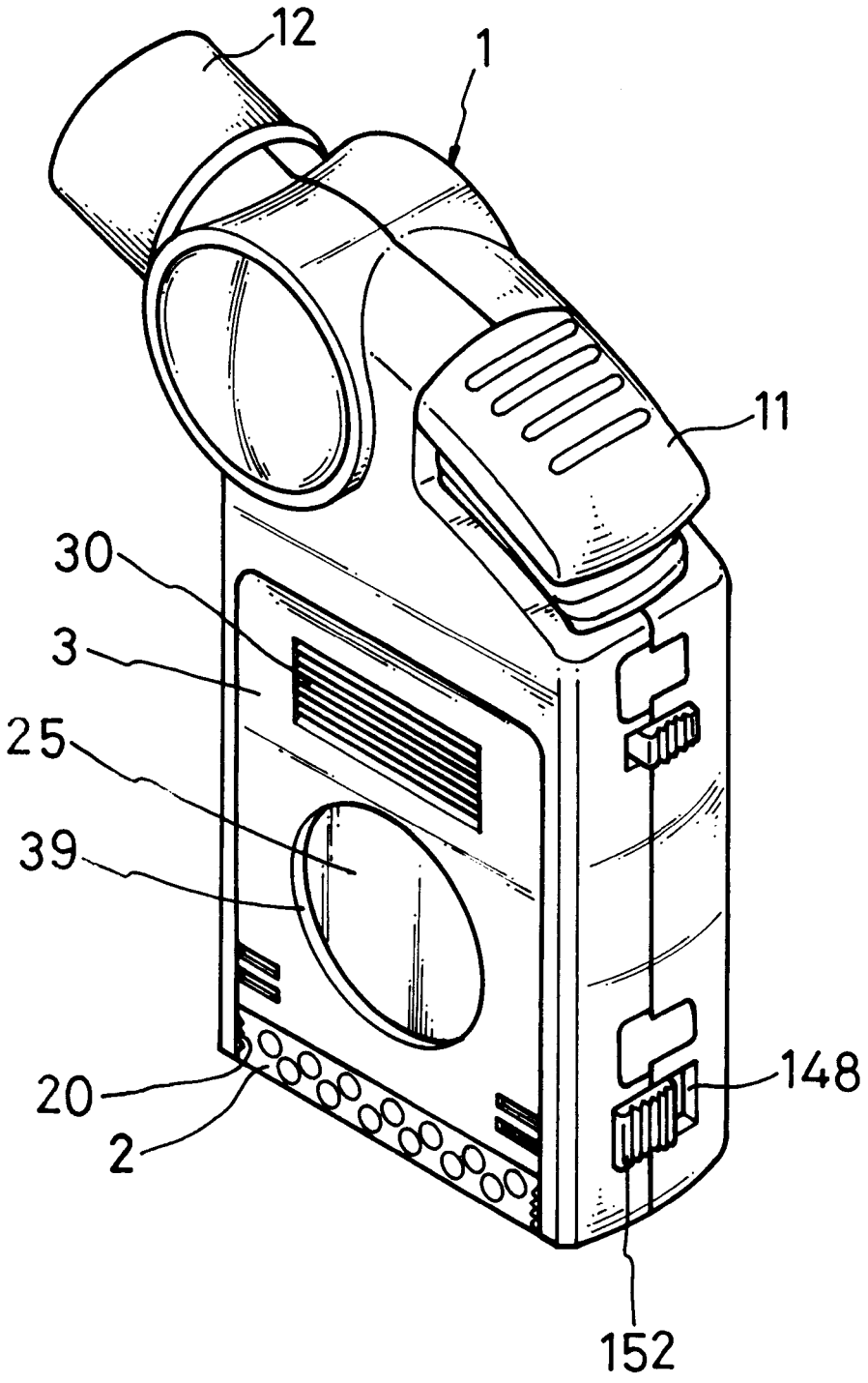
FIG. 4 is another perspective view of the present invention, showing the slide received inside the slide box, the slide box received inside the housing of the gas lighter unit.

Referring to FIG. 3 and FIG. 1 again, the slide 2 is a substantially U-shaped frame having a fluted base 20 for holding by hand, two parallel arms 21;22 raised from the fluted base 20 and terminating in a respective hooked portion 23, a recessed cutter seat 24 integral with the arms 21;22 at one side which holds a cutter blade 25, a plurality of springy retainer strips 26 adapted to hold down the cutter blade 25 in the recessed cutter seat 24, a raised portion 27 at one side, a first lock hole 28 and a second lock hole 29 corresponding to the through holes 144;147 on the side wall 142 of the housing 14 for receiving the first locking rod 151 and second locking rod 154 of the sliding switch 15.

The slide box 3 is a flat, rectangular box comprising two longitudinal side rails 31 adapted for inserting into the sliding grooves 143 on the housing 14, a chamber 32 through its front and rear ends adapted for receiving the slide 2, a blade hole 39 intersecting the chamber 32, two stop flanges 321;322 bilaterally disposed inside the chamber 32 and adapted for stopping against the hooked portions 23 of the arms 21;22 to limit downward stroke of the slide 2 in the slide box 3, a plurality of longitudinal grooves 323 disposed inside the chamber 32 and adapted to receive the springy retainer strips 26, a locating hole 33 adapted for receiving the raised portion 27 on the slide 2 for permitting the slide 2 to be retained in the chamber 32 within the slide box 3, a first bottom lock hole 35 and a second bottom lock hole 36 corresponding to the through holes 144;147 on the side wall 142 of the housing 14 which receive the first locking rod 151 and second locking rod 154 of the sliding switch 15 respectively when the slide box 3 is received within the housing 14, a first top lock hole 37 and a second top lock hole 38 corresponding the through holes 144;147 on the side wall 142 of the housing 14 which receive the first locking rod 151 and second locking rod 154 of the sliding switch 15 respectively when the slide box 3 is extended out of the housing 14, two fluted handhold portions 30 at two opposite lateral sides for the holding of the hand, and a longitudinal locating groove 34 which receives the springy hook 145 on the side wall 142 of the housing 14.

Referring to Figures from 1 to 4 again, the slide 2 is inserted into the chamber 32 in the slide box 3 from the bottom side, permitting the raised portion 27 of the slide 2 to be forced into engagement with the locating hole 33 on the slide box 3, then the sliding switch 15 is moved backwards for permitting the side rails 31 of the slide box 3 to be respectively inserted into the sliding grooves 143 on the housing 14, and then the sliding switch 15 is released and pushed forward by the spring 156 to force the first locking rod 151 and second locking rod 154 of the sliding switch 15 into the first bottom lock hole 35 and second bottom lock hole 36 on the slide box 3 and the first lock hole 28 and second lock hole 29 on the slide 2. When assembled, the push member 42 is forced upwards by the slide box 3, and the compression spring 41 is compressed.

When in use, the flat knob 152 is pushed backwards with one hand to compress the spring 156 and to release the first locking rod 151 and second locking rod 154 from the first bottom lock hole 35 and second bottom lock hole 36 on the slide box 3 and the first lock hole 28 and second lock hole 29 on the slide 2, for permitting the slide box 3 to be pushed downwards by the spring 41 through the push member 42, and then the slide 2 is pulled out of the chamber 32 of the slide box 3 with the other hand. When the slide 2 is pulled out of the chamber 32 of the slide box 3, the hooked portions 23 of the arms 21;22 are respectively stopped above the stop flanges 321;322 inside the chamber 32 to limit down stroke of the slide 2, and at the same time the sliding switch 15 is released, for permitting the first locking rod 151 and second locking rod 154 of the sliding switch 15 to be forced by the spring 156 into engagement with the first top lock hole 37 and second top lock hole 38 on the slide box 3 to hold the slide box 3 in the extended position as shown in FIG. 3. After the slide 2 has been extended out of the slide box 3 and the slide box 3 has been extended out of the housing 14, the head of the cigar is inserted into the blade hole 39 on the slide box 3, and then the slide 2 is pushed inward to force the cutter blade 25 against the head of the cigar, and therefore the head of the cigar is off. After cutting, the sliding switch 15 is pushed backwards again, for permitting the slide 2 with the slide box 3 to be moved back to the inside of the housing 14 along the sliding grooves 143. After the slide box 3 has been received in the housing 14, the sliding switch 15 is released from the hand, permitting the first locking rod 151 and second locking rod 154 of the sliding switch 15 to be respectively forced into the first bottom lock hole 135 and second bottom lock hole 36 on the slide box 3 and the first lock hole 28 and second lock hole 29 on the slide 2. Thus, the user can then operate the press button switch 11 to produce a flame at the flame nozzle 12 for burning the well cut cigar for smoking.

While only one embodiment of the present invention has been shown and described, it will be understood that various modifications and changes could be made thereunto without departing from the spirit and scope of the invention disclosed.

What the invention claimed is:

1. A gas lighter comprising:

a gas lighter unit, said gas lighter unit comprising a butane well holding a liquefied fuel gas, a flame nozzle at which discharged fuel gas from said butane well is burned, a press button switch which controls a gas output port of said butane well and the operation of an igniter inside said gas lighter unit, a housing holding said butane well, said flame nozzle and said press button switch, said housing comprising a side wall, two longitudinal side rails bilaterally raised from said side wall, two longitudinal sliding grooves defined between said side wall and said side rails, a sliding switch moved in a transverse sliding slot at a back side thereof, and at least one through hole on said side wall, said sliding switch comprising at least one locking rod moved with said sliding switch in and out of said at least one through hole on said side wall of said housing between a locking position and an unlocking position;

a slide box inserted into said longitudinal sliding grooves and moved between a first position where said slide box is received inside said housing, and a second position where said slide box is extended out of said housing, said slide box comprising a chamber through front and rear sides thereof, a blade hole intersecting said chamber into which a head of a cigar is inserted for cutting by a cutter blade, two longitudinal side rails adapted for inserting into the longitudinal sliding grooves on said housing, two stop flanges bilaterally disposed inside said chamber, at least one bottom lock hole adapted to receive said at least one locking rod of said sliding switch for permitting said slide box to be retained in said first position, at least one top lock hole adapted to receive said at least one locking rod of said sliding switch for permitting said slide box to be retained in said second position; and a slide moved in and out of said chamber of said slide box, said slide comprising two parallel arms, a recessed cutter seat integral with said arms, a cutter blade mounted in said recessed cutter seat, and at least one lock hole adapted to receive the at least one locking rod of said sliding switch for permitting said slide to be retained in said chamber inside said slide box, said arms having a respective top end terminating in a hooked portion, the hooked portions of said arms being stopped above said stop flange of said slide box to stop said slide from escaping out of said slide box when said slide is extended out of said slide box.

2. The gas lighter of claim 1, wherein said side wall of said housing is integral with a springy hook adapted to limit the moving range of said slide box in said sliding grooves; said slide box comprises a longitudinal locating groove which receives said springy hook on said side wall of said housing.

3. The gas lighter of claim 1, wherein said side wall of said housing has a longitudinal peephole through which the quantity of liquefied fuel gas in said butane well is viewed.

4. The gas lighter of claim 1 wherein said sliding switch comprises a flat knob disposed outside the sliding slot on said housing, a first locking rod disposed in parallel to said flat knob and moved with said sliding switch in and out of said at least one through hole on said side wall of said housing, for locking/unlocking said slide box, a transverse rod inserted through the sliding slot on said housing and fixedly connected between said flat knob and said first locking rod, a second locking rod perpendicularly raised from said transverse rod at one side and moved with said sliding switch in and out of said at least one through hole on said side wall of said housing for locking/unlocking said slide box, a locating rod perpendicularly raised from said transverse rod at one side opposite to said second locating rod, and a compression spring mounted around said locating rod and received in a spring holder on an outside wall of said butane well and imparting an outward pressure to said transverse rod to force said first locking rod and said second locking rod out of said at least one through hole said side wall of said housing.

5. The gas lighter of claim 4, wherein said slide box comprises a first top lock hole and a second top lock hole adapted to receive said first locking rod and said second locking rod of said sliding switch for permitting said slide box to be locked in a first position where said slide box is extended out of said housing of said gas lighter unit, a first bottom lock hole and a second bottom lock hole adapted to receive said first locking rod and said second locking rod of said sliding switch for permitting said slide box to be locked in a second position where said slide box is received inside said housing of said gas lighter unit.

6. The gas lighter of claim 1 further comprising an ejector mounted in a trough on said side wall of said housing at a top side and adapted to push said slide box out of said housing along said sliding grooves, said ejector comprising a cylindrical block mounted in said trough at a top side, a push member mounted in said trough at a bottom side, and a spring connected between said cylindrical block and said push member and imparting a downward pressure to said push member, said push member having a push rod extended out of a hole at a bottom side on said trough which stops at a top side of said slide box when said slide box is received inside said housing.

7. The gas lighter of claim 1, wherein said slide box comprises a locating hole at one side in communication with said chamber, said slide comprises a raised portion at an outer side, said raised portion of said slide being forced into engagement with the locating hole on said slide box, permitting said slide to be retained in said chamber inside said slide box.

8. The gas lighter of claim 1, wherein said slide comprises a plurality of springy retainer strips adapted to hold down said cutter blade in said recessed cutter seat; said slide box comprises a plurality of longitudinal grooves inside said chamber for receiving said springy retainer strips of said slide.

9. The gas lighter of claim 1, wherein said slide box has two fluted hand-hold portions at two opposite sides for the holding by the hand; said slide has a fluted base for the holding by the hand.

10. The gas lighter of claim 1, wherein each of said at least one top locking hole of said slide box has a sloping bottom edge adapted for guiding said at least one locking rod of said sliding switch into engagement with said at least one top locking hole of said slide box.

* * * * *